US009968180B2

(12) United States Patent
Moreau et al.

(10) Patent No.: US 9,968,180 B2
(45) Date of Patent: May 15, 2018

(54) DROP PREVENTION APPARATUS AND SYSTEM FOR HAND TOOLS

(71) Applicant: Ty-Flot, Inc., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 75 days.

(21) Appl. No.: 15/262,577

(22) Filed: Sep. 12, 2016

(65) Prior Publication Data

US 2018/0070713 A1 Mar. 15, 2018

(51) Int. Cl.
*A45F 5/00* (2006.01)
*A45F 5/02* (2006.01)
*B25H 3/00* (2006.01)

(52) U.S. Cl.
CPC ..... *A45F 5/021* (2013.01); *B25H 3/00* (2013.01); *A45F 2005/006* (2013.01); *A45F 2200/0575* (2013.01)

(58) Field of Classification Search
CPC ..... A45F 2200/0575; A45F 2005/006; Y10S 224/904
USPC ..... 224/220, 254, 904; 182/5
See application file for complete search history.

(56) References Cited

U.S. PATENT DOCUMENTS

D139,568 S * 11/1944 Hinchman ..... D8/356
4,558,495 A * 12/1985 Olsen ..... B23B 45/006 24/16 PB
4,678,059 A * 7/1987 Bowker ..... A62B 1/04 182/5
5,332,071 A * 7/1994 Duncan ..... A62B 35/04 188/371
5,816,458 A * 10/1998 Yonenoi ..... A45F 5/02 224/182
D430,005 S * 8/2000 Stearns ..... D8/380
6,095,282 A * 8/2000 Sadeck ..... A62B 1/04 182/191
D458,533 S * 6/2002 Sonju ..... A63B 29/02 D8/356
6,776,317 B1 * 8/2004 Parker ..... A45F 5/00 224/250
6,835,032 B1 * 12/2004 Pozgay ..... B25F 5/02 144/136.95
6,868,586 B1 * 3/2005 Hall ..... A63B 21/0552 24/115 A (Continued)

*Primary Examiner* — Justin Larson
(74) *Attorney, Agent, or Firm* — Robert R. Deleault, Esq.; Mesmer & Deleault, PLLC

(57) ABSTRACT

A drop prevention apparatus and system for hand tools includes a drop prevention anchor having an anchor body with a proximal body end portion, a middle body portion and a distal body end portion, a leader aperture through the proximal body end portion, a first tool aperture through the middle body portion, and a second tool aperture through the distal body end portion where the drop prevention anchor is securely attached to a hand tool and where one of the first tool aperture or the second tool aperture is configured for attaching a tool lanyard connector and the other is configured for attaching a tool securing connector of a tool pouch such that one of the tool lanyard connector or the tool securing connector are securely connected directly to the drop prevent anchor at all times.

15 Claims, 9 Drawing Sheets

(56) References Cited

U.S. PATENT DOCUMENTS 7,093,329 B1 * 8/2006 Chiu ..... A63B 21/0552 24/300
7,458,135 B2 * 12/2008 Mikesell ..... B25H 3/006 24/300
D618,536 S * 6/2010 Eason ..... D8/349
7,819,787 B2 * 10/2010 Kassel ..... A63B 21/00043 24/300
D675,084 S * 1/2013 Moreau ..... A45F 5/00 D8/356
D676,311 S * 2/2013 Moreau ..... D8/356
8,403,132 B2 * 3/2013 Moreau ..... A45F 5/021 206/234
D679,577 S * 4/2013 Moreau ..... D8/356
D684,845 S * 6/2013 Wood ..... A62B 35/04 D8/356
8,567,290 B2 * 10/2013 Moreau ..... B25B 7/00 248/309.1
8,646,768 B2 * 2/2014 Kish ..... A45F 5/00 224/251
D706,123 S * 6/2014 Mathews ..... D8/382
D710,186 S * 8/2014 Earley ..... D8/354
D713,240 S * 9/2014 Chance ..... D8/356
D718,117 S * 11/2014 Moreau ..... A45F 5/00 D8/356
8,919,629 B2 * 12/2014 Moreau ..... A45F 5/004 2/66
8,997,317 B2 * 4/2015 Rinklake ..... A62B 35/04 24/300
9,232,850 B2 * 1/2016 Moreau ..... A45F 5/02
9,339,100 B2 * 5/2016 Moreau ..... A45F 5/00
9,402,457 B2 * 8/2016 Moreau ..... A45F 5/00
D775,517 S * 1/2017 Votel ..... D8/382
D789,188 S * 6/2017 Votel ..... D8/382
9,791,102 B2 * 10/2017 Moreau ..... F16M 13/04
9,801,457 B2 * 10/2017 Moreau ..... A45F 5/00
9,833,893 B2 * 12/2017 Moreau ..... B25H 3/006
2003/0102342 A1 * 6/2003 Fogg ..... A45F 5/02 224/269
2004/0200436 A1 * 10/2004 Staack ..... A01K 1/04 119/792
2008/0163464 A1 * 7/2008 Baumann ..... A45F 5/02 24/3.12
2010/0147912 A1 * 6/2010 Salentine ..... A45F 5/02 224/254
2012/0168472 A1 * 7/2012 Mathews ..... A45F 3/14 224/162
2012/0247994 A1 * 10/2012 Moreau ..... A45F 5/021 206/373
2012/0267403 A1 * 10/2012 Ward, Jr. ..... A45F 5/00 224/219
2013/0062498 A1 * 3/2013 Ito ..... B25B 21/00 248/672
2014/0013544 A1 * 1/2014 Moreau ..... A45F 5/00 24/3.12
2015/0202470 A1 * 7/2015 He ..... A62B 1/14 182/5
2015/0289633 A1 * 10/2015 Moreau ..... A45F 5/00 29/447
2016/0199678 A1 * 7/2016 Tsai ..... C08G 18/4841 248/636
2016/0227911 A1 * 8/2016 Benzakin ..... A45F 3/14
2016/0257065 A1 * 9/2016 Moreau ..... B25H 3/00
2016/0375575 A1 * 12/2016 Moreau ..... B25H 3/00 29/401.1
2017/0119137 A1 * 5/2017 Cirincione, II ..... A45F 5/00

* cited by examiner

Fig. 13
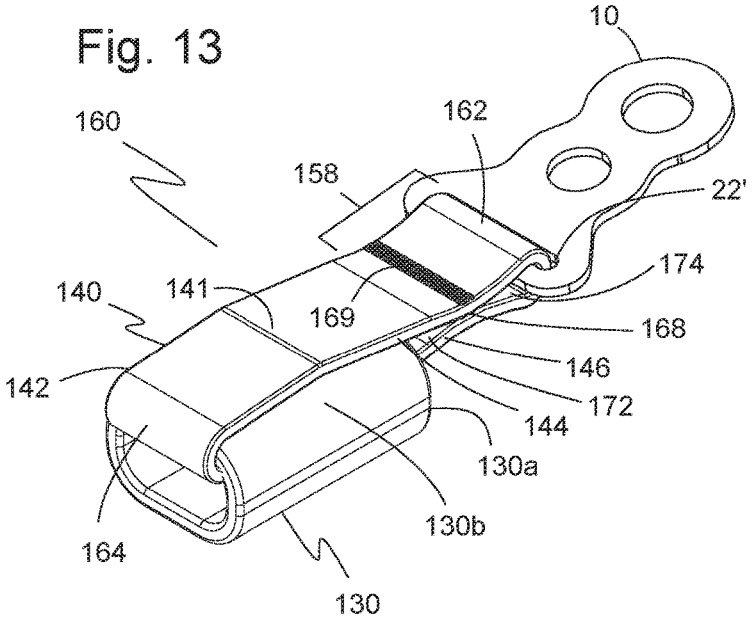
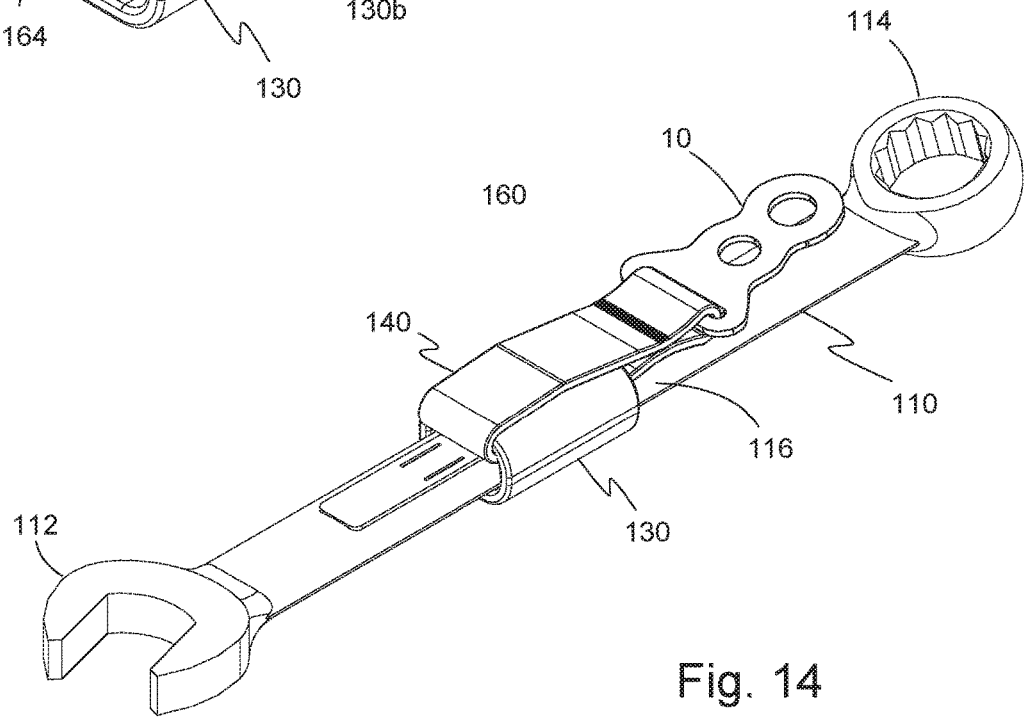
Fig. 14

Fig. 15
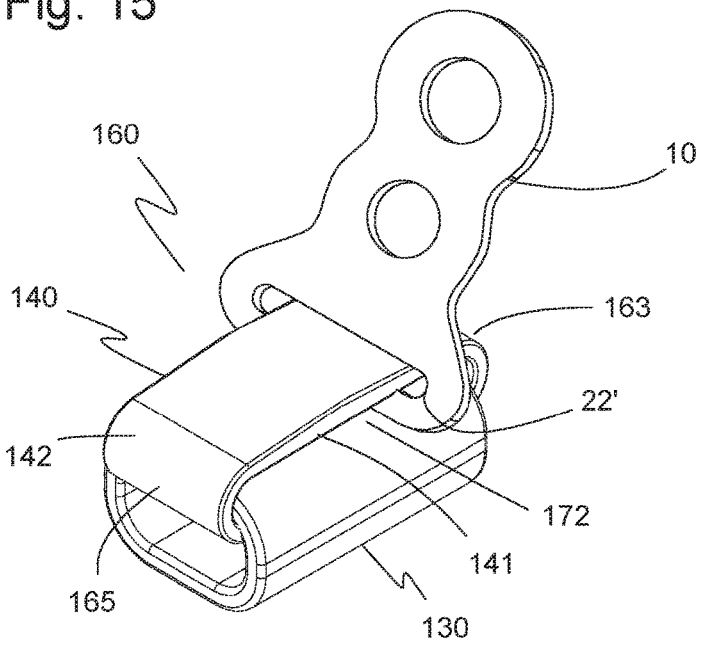
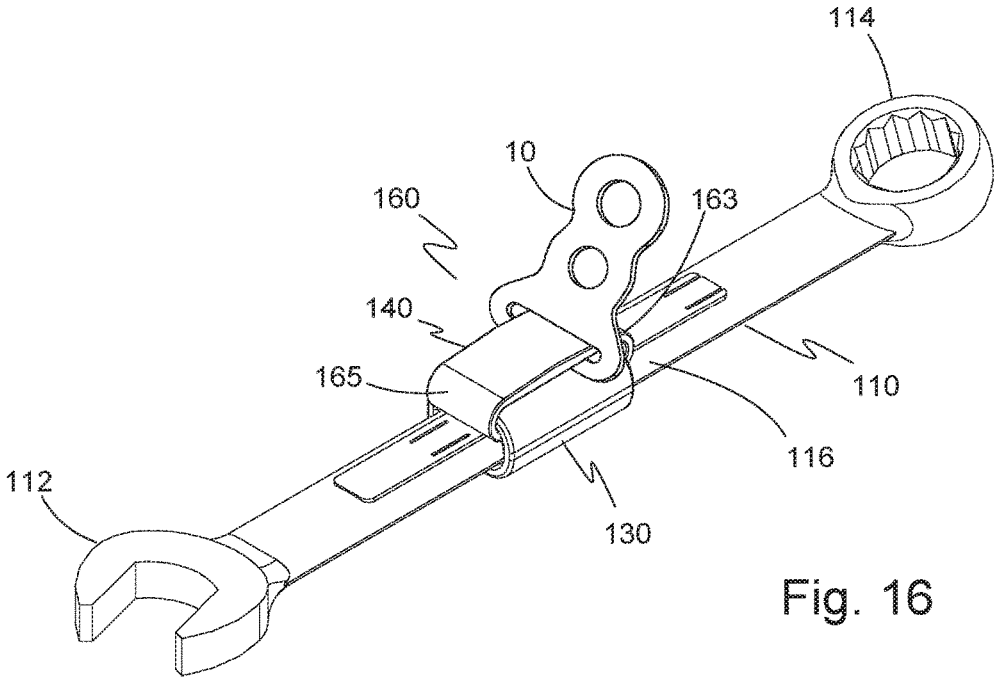
Fig. 16

DROP PREVENTION APPARATUS AND SYSTEM FOR HAND TOOLS

BACKGROUND OF THE INVENTION

1. Field of the Invention

The present invention relates generally to hand tools and accessories. Particularly, the present invention relates to a drop prevention device for hand tools and other objects.

2. Description of the Prior Art

Hand tools are widely used in construction, maintenance, and industrial facility operations. The user of a tool often stores tools in a bag, box, pouch, or tool belt when the tool is not being used. The user then selects the appropriate tool for a given task and returns the tool to its storage location after the task is complete. For tasks performed at elevated heights, dropping a tool can cause injury to individuals or damage to objects below the worker. The dropped tool also is a significant inconvenience for workers who must spend time to retrieve the dropped tool.

Tool makers have partially addressed the problem of dropped tools by attaching a ring to a tool, which is connected to the ring through an opening in the end of the tool handle. For example, a metal ring passes through an opening in the end of a handle of a hammer or pipe wrench. Another method of addressing this problem is to attach a ring or grommet to the tool by forming a sleeve over the end of the tool's handle or grip where the sleeve has a solid end with an opening in the solid end. For example, one line of tools includes hammers, hinged pliers, and adjustable spanners that have a rubber sleeve formed over the grip of the tool with a solid end portion of the sleeve extending beyond the end of the grip. A ring passes through an opening or grommet in the solid end of the rubber sleeve. The user clips one end of a lanyard to the ring and attaches the other end of the lanyard to the user's tool belt, scaffolding, ladder, or other object.

Some tools and equipment lack an opening, hook, or other feature that enables the user to securely attach a tether. Attempts have been made to tether wrenches, pliers, hammers and other tools by securing a connector to the tool with a leader looped through the connector and around the handle. Tools such as, for example, tubing tongs, valve wheel wrenches, spud wrenches, pipe wrenches, hammers, alignment bars and the like used in construction have posed a particular challenge since these tools often have a smooth handle, two working ends, or a handle that tapers towards one end. Such features render these tools particularly difficult for attaching and securely maintaining a tether connection on the tool.

To address this situation, one tethering method uses heat-shrink tubing to connect a connector strap to the tool, where the connector strap includes a D-ring connector. One connector strap known to some as a "web tail" is a length of webbing with a first end looped through the connector and then secured to itself to attach the connector loop to the length of webbing. The first end of the webbing provides a first catch where the end of the webbing is doubled on itself. A second end of the webbing is folded or double folded on itself and then stitched together or otherwise secured in this position to define a second catch where the webbing is doubled or tripled on itself. The web tail is attached to the tool handle by using heat shrink tubing positioned around the tool handle with the web tail between the shrink tubing and the tool handle where the first catch and the second catch are positioned outside and beyond the ends of the shrink tubing. After positioning the heat shrink tubing, the tubing is heated to constrict its size to the tool handle and web tail, thereby fixing the web tail to the tool handle.

In another approach, the user places the web tail along the handle of a tool with the catch of the doubled-over webbing facing away from the tool handle. A self-fusing silicone rubber tape is then wrapped tightly around the tool and over the web tail while also slightly stretching the tape. The tape adheres to itself to secure the web tail to the tool, thereby attaching the web tail to the tool and providing a connection point for a spring clip or other connector. This approach has been found to be satisfactory for tools having a weight below five pounds.

Prior art devices describing the above approaches include the following patent documents.

U.S. Pat. No. 9,339,100 (2016, Moreau et al.) discloses a lanyard attachment assembly. The assembly has a sleeve with an inside surface and an outside surface, the inside surface defines a passageway through the sleeve. A strap passes through the passageway and forms a closed loop to link the closed loop to the sleeve. The assembly optionally includes a connector with a connector opening therethrough. When the assembly includes a connector, the strap passes through the connector opening where the closed loop links the connector to the sleeve.

U.S. Pat. No. 8,646,768 (2014, Kish et al.) discloses a quick spin holder for tools and accessories. The holder is adapted to be attached to a tether to help retrieve a dropped tool or prevent a dropped tool from being lost or forgotten during use. The holder has a hollow member with an open end and a closed end and is adapted to frictionally hold a non-working end of a tool in the hollow member. The closed end of the hollow member has a centrally located opening within which is located a cylindrical member which is connected at one end to a shoulder connector and is coupled to an attachment means at its other end. The cylindrical member can be either fixed or rotatably coupled to the opening in the hollow member and the attachment means is configured to be attached to an end of a tether.

U.S. Patent Publication No. 2010/0101066 (2010, Stein et al.) discloses a device for attaching a rope to a handle. The device includes at least a partially tube-shaped cover that is elastically deformable at least in the circumferential direction of the tube shape and has an anchoring for the rope.

U.S. Pat. No. 4,591,156 (1986, Atenni) discloses a removable device for attaching a racket to a player's wrist. The device includes a flexible wrist strap that encircles a player's wrist and a soft rubber cap that grips the end of the handgrip and has a rigid female insert that releasably retains a male assembly on the wrist strap. The insert has a central opening for receiving a portion of the male assembly and further includes an abutment shoulder that faces inwardly.

SUMMARY OF THE INVENTION

The use of prior art tool lanyards typically involves attaching a tool lanyard to a hand tool in a tool pouch or tool belt. Unfortunately, the hand tool is typically supported in a tool pouch or tool belt but not secured to the tool pouch or tool belt. The user normally picks up the hand tool from the tool pouch or tool belt and then attaches the tool lanyard to the hand tool. It is at this point in time between removal of the hand tool from the tool pouch or tool belt and securing the hand tool lanyard to the hand tool that there is the vulnerability of an inadvertent or accidental drop. If this occurs, any equipment below the dropped tool can be damaged and, even worse, if a worker is below the dropped tool, the worker may sustain injuries from the dropped tool.

It is an object of the present invention to provide a drop prevention apparatus and system to ensure that an inadvertent or accidental drop of an unsecured hand tool does not occur.

It is another object of the present invention to provide a drop prevention apparatus and system that promotes having a hand tool always attached to a tool pouch/tool belt or a tool lanyard.

The present invention achieves these and other objectives by providing a drop prevention apparatus and system for hand tools that includes at least a drop prevention anchor. In one embodiment, the drop prevention anchor includes an anchor body, a leader aperture, a first tool aperture, and a second tool aperture. The anchor body has a proximal body end portion, a middle body portion, a distal body end portion, and a distal body end. The leader aperture is disposed completely through the anchor body in the proximal body end portion. The leader aperture is sized to permit secure attachment of an anchor securing leader therethrough. The first tool aperture is disposed completely through the anchor body in the middle body portion and the second tool aperture is disposed completely through the anchor body in the distal body end. The first tool aperture is sized to permit secure attachment of one of a lanyard connector of a hand tool lanyard or a tool securing connector of a hand tool pouch and/or hand tool belt to the first aperture. Likewise, the second tool aperture is sized to permit secure attachment of the other of the lanyard connector or the tool securing connector to the second tool aperture.

In one embodiment of the present invention, the drop prevention apparatus and system includes an anchor securing leader. The anchor securing leader may be any cord or strap. The preferred form is a strap. The anchor securing leader has a proximal leader end portion, a distal leader end portion, a leader middle portion, a proximal leader end, and a distal leader end. The proximal leader end portion is disposed through the leader aperture of the drop prevention anchor and retains drop prevention anchor securely to the anchor securing leader. When a strap is used, the leader aperture is an elongated slot. The leader middle portion has a predefined length sufficient to permit binding of at least the leader middle portion to a hand tool.

In another embodiment of the present invention, the distal leader end portion has a thickness greater than a thickness of the leader middle portion.

In another embodiment, the anchor leader is a strap made of a material selected from woven, non-woven, knitted, braided, or solid material.

In one embodiment, the anchor securing material is a solid material made of rubber, cloth, metal, plastic, or any combination thereof.

In one embodiment, the anchor securing material is made of nylon webbing.

In a further embodiment of the drop prevention apparatus and system, there is included a hand tool pouch and/or a hand tool belt. The hand tool pouch and/or the hand tool belt has a tool securing connector fixedly attached to and positioned on the hand tool pouch and/or hand tool belt such that the tool securing connector is capable of releasable but secure connection directly to the drop prevention anchor when the drop prevention anchor is attached to a hand tool. For example, when the tool pouch has a tool pocket for receiving a hand tool, the tool securing connector is positioned near the tool receiving end of the tool pocket to facilitate attachment of the tool securing connector to the hand tool.

In one embodiment, the anchor body is a planar elongated body.

In one embodiment, the anchor body is a planar elongated body having at least one side with a serpentine shape between the proximal body end portion and the distal body end.

In another embodiment of the present invention where the anchor body has at least one serpentine side, each of the first tool aperture and the second tool aperture of the drop prevention anchor is adjacent to and aligned with a convex-shaped portion of the serpentine side. A concave-shaped portion of the serpentine side is between the convex-shaped portion adjacent the first tool aperture and the convex-shaped portion adjacent the second tool aperture.

In one embodiment of the present invention, the anchor body of the drop prevention anchor has a second serpentine side opposite the at least one serpentine side. The second serpentine side also extends between the proximal body end portion and the distal body end.

In another embodiment of the present invention, the proximal end portion of the drop prevention anchor is wider than either of the middle body portion or the distal body portion.

In one embodiment of the present invention, a method of tethering a hand tool that maintains the hand tool being secured at all times is disclosed. The method includes providing a hand tool with a drop prevention anchor securely connected to the hand tool, providing a tool pouch having a tool pocket in which is disposed the hand tool with the drop prevention anchor where the tool pouch has at least one tool securing connector fixedly attached to the hand tool pouch where the tool securing connector is releasably connected directly to the drop prevention anchor, providing a hand tool lanyard having a lanyard connector capable of releasably connecting directly to the drop prevention anchor, attaching the lanyard connector directly to the drop prevention anchor before releasing the tool securing connector of the hand tool pouch from the drop prevention anchor, and releasing the tool securing connector of the hand tool pouch from the drop prevention anchor. The hand tool can then be safely removed from the hand tool pouch/tool belt while ensuring that the hand tool is always secured to either the tool securing connector of the tool pouch/tool belt, or to the tool lanyard.

In another embodiment of the method, the method includes providing a drop prevention anchor having a planar elongated body with a proximal body end portion, a middle body portion and a distal body end portion, a leader aperture disposed completely through the elongated body in the proximal body end portion, a first tool aperture disposed completely through the elongated body in the middle body portion, a second tool aperture disposed completely through the elongated body in the distal body end portion, and an anchor securing leader with a proximal leader end securely connected to the leader aperture in the proximal body end portion of the drop prevention anchor and with the leader middle portion bound to the hand tool.

In another embodiment of the method, the method includes providing a tool pouch where the tool securing connector is releasably connected to one of the first tool aperture or the second tool aperture of the drop prevention anchor bound to the hand tool.

In a further embodiment of the method, the method includes providing a hand tool lanyard having a lanyard connector capable of releasably connecting to the other of the first tool aperture or the second tool aperture of the drop prevention anchor.

In still another embodiment of the method of the present invention, ensuring that the hand tool is always connected to either the lanyard connector of the hand tool lanyard or the tool securing connector of the hand tool pouch/tool belt by always having at least one of the lanyard connector and the tool securing connector directly connected to the drop prevention anchor.

In yet another embodiment of the method of the present invention, the method includes returning the hand tool with the hand tool lanyard connected thereto to the hand tool pouch, attaching the tool securing connector of the tool pouch/tool belt to the drop prevention anchor connected to the hand tool lanyard of the hand tool, and then releasing the lanyard connector of the hand tool lanyard from the drop prevention anchor to thereby ensure that the hand tool is always connected to one of the lanyard connector of the hand tool lanyard or the tool securing connector of the hand tool pouch/tool belt.

BRIEF DESCRIPTION OF THE DRAWINGS

FIG. 13 is a perspective view of the drop prevention assembly of FIG. 11 showing the drop prevention anchor in a different orientation relative to the sleeve.

FIG. 14 is a perspective view of the drop prevention assembly of FIG. 13 attached to a hand tool.

FIG. 15 is a perspective view of still another embodiment of a drop prevention assembly of the present invention.

FIG. 16 is a perspective view of the drop prevention assembly of FIG. 15 attached to a hand tool.

DETAILED DESCRIPTION OF THE EMBODIMENTS

Figure 1:
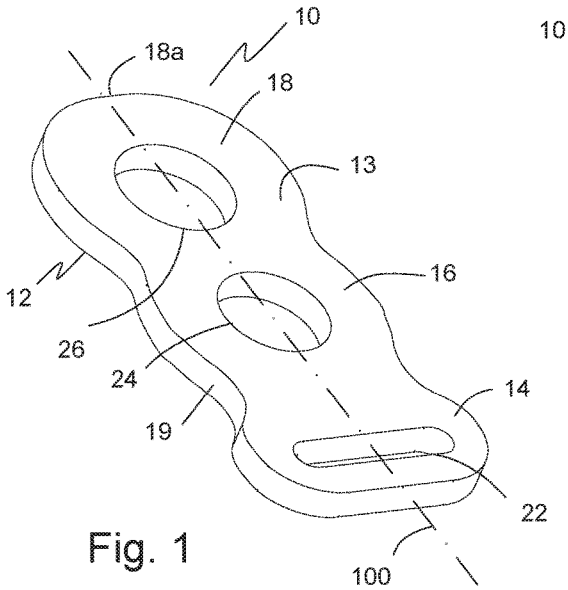
FIG. 1 is a perspective view of one embodiment of the present invention showing a drop prevention anchor.
Figure 2:
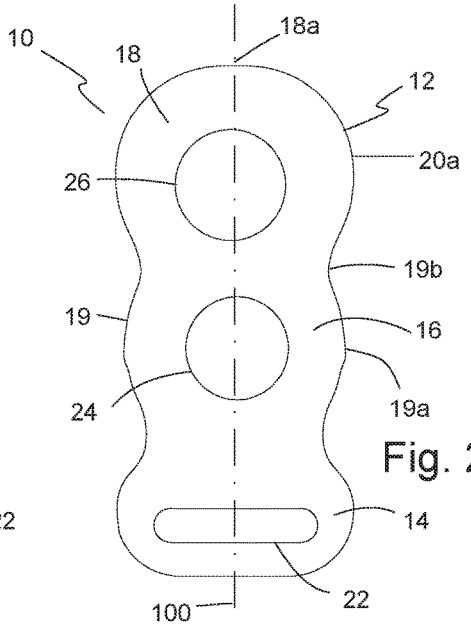
FIG. 2 is a top plan view of the embodiment shown in FIG. 1.

The embodiments of the present invention are illustrated in FIGS. 1-17. FIGS. 1 and 2 show one embodiment of a drop prevention anchor 10 of the present invention. Drop prevention anchor 10 has an anchor body 12 with a proximal body end portion 14, a middle body portion 16, a distal body end portion 18, and a distal body end 18*a*. Drop prevention anchor 10 also includes a leader aperture 22 that is an elongated slot 22 in this embodiment, a first tool aperture 24 and a second tool aperture 26. Leader aperture 22 is disposed completely through the anchor body 12 in the proximal body end portion 14. First tool aperture 24 is disposed completely through the anchor body 12 in the middle body portion 16. Second tool aperture 26 is disposed completely through the anchor body 12 in the distal body end portion 18. In this embodiment where leader aperture 22 is an elongate slot 22, elongated slot 22 extends transversely relative to a longitudinal axis 100 of drop prevention anchor 10. Particularly as shown in FIG. 2, elongated slot 22 extends perpendicularly relative to longitudinal axis 100. It is contemplated that elongated slot 22 may be at any angle relative to longitudinal axis 100 including that it may be parallel to longitudinal axis 100. Also shown in this embodiment, elongated slot 22, first tool aperture 24 and second tool aperture 26 are linearly aligned relative to each other along longitudinal axis 100 of drop prevention anchor 10. Elongated slot 22 is configured to accept an anchor-securing leader 40, which is described in more detail later. In this embodiment, anchor body 12 is a planar elongated body.

Figure 3:
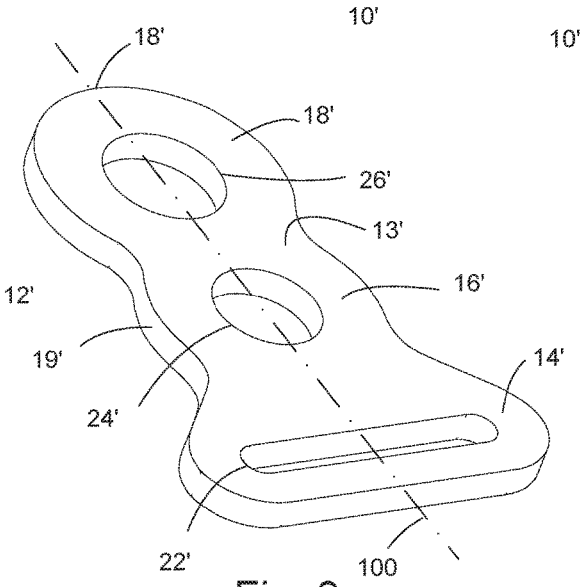
FIG. 3 is a perspective view of another embodiment of the present invention showing a drop prevention anchor having a wider proximal end portion.
Figure 4:
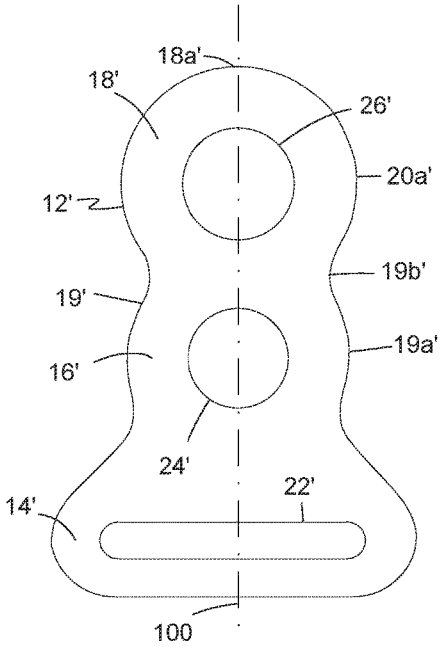
FIG. 4 is a top plan view of the embodiment shown in FIG. 3.

Turning now to FIGS. 3 and 4, there is illustrated another embodiment of a drop prevention anchor of the present invention. Drop prevention anchor 10' has an anchor body 12' with a proximal body end portion 14', a middle body portion 16', a distal body end portion 18', and a distal body end 18*a'*. Drop prevention anchor 10' also includes, in this embodiment, an elongated slot 22', a first tool aperture 24' and a second tool aperture 26'. Elongated slot 22' is disposed completely through the anchor body 12' in the proximal body end portion 14'. First tool aperture 24' is disposed completely through the anchor body 12' in the middle body portion 16'. Second tool aperture 26' is disposed completely through the anchor body 12' in the distal body end portion 18'. In this embodiment as in the embodiment illustrated in FIGS. 1-2, elongated slot 22' extends transversely relative to a longitudinal axis 100 of drop prevention anchor 10'. Particularly as shown in FIG. 4, elongated slot 22' extends perpendicularly relative to longitudinal axis 100. It is contemplated that elongated slot 22' may be at any angle relative to longitudinal axis 100 including that it may be parallel to longitudinal axis 100. Also shown in this embodiment, elongated slot 22', first tool aperture 24' and second tool aperture 26' are linearly aligned relative to each other along longitudinal axis 100 of drop prevention anchor 10'. As previously described, elongated slot 22' is adapted for securing an anchor-securing leader thereto.

First and second tool apertures 24, 24', 26, 26' may have a shape that is circular, triangular, square, rectangular, oval, elliptical, trapezoidal, or any shape desired. First and second tool apertures 24, 24', 26, 26' may have the same shape or different shapes and may be the same size or different sizes. The only limitation to the sizes of first and second tool apertures 24, 24', 26, 26' is that they be sufficient for accepting a clip-type fastener. One advantage of having different sizes and/or different shapes would be for identifying and/or associating a specific clip-type fastener to attach to one of the first or second tool apertures 24, 24', 26, 26'.

As shown in FIGS. 2 and 4, one of the differences between drop prevention anchor 10 and drop prevention anchor 10' is that proximal body end 14' is wider than proximal body end 14. The wider proximal body end 14' accommodates elongated slot 22', which is longer than elongated slot 22. One advantage of a longer slot is that elongated slot 22' accepts a wider anchor-securing leader, which, in turn, allows for use on hand tools of heavier weight.

Elongated body 12, 12' may also have a variety of circumferential shapes and cross-sectional shapes. In the illustrated embodiments, elongated body 12, 12' is planar. In other words, it has at least one flat surface 13, 13' but could have two opposed flat surfaces such as is typical of plate material. Elongated body 12, 12' may be made of metal, plastic, composites, and/or other relatively rigid materials that maintain their shape and have sufficient strength, hardness and stiffness to withstand a load imparted by a connector of a hand tool lanyard against the drop prevention anchor 10, 10' when a hand tool attached to the hand tool lanyard is inadvertently or accidentally dropped and the hand tool lanyard stops the fall of the hand tool.

In the illustrated embodiments, elongated body 12, 12' have at least one body side 19, 19' that has a serpentine shape thereby having a serpentine side. Elongated body 12, 12' may have opposed sides that are serpentine sides, however, elongated body 12, 12' may have straight sides such as those of a square, a rectangle or any multi-sided geometric figure. When elongated body 12, 12' has at least one serpentine side 19, 19', each of the first and second tool apertures 24, 24', 26, 26' is adjacent to and aligned with a convex-shaped portion 19*a*, 19*a'*, 20*a*, 20*a'* of the serpentine side 19, 19' with a concave-shaped portion 19*b*, 19*b'* of serpentine side 19, 19' between convex-shaped portion 19*a*, 19*a'* adjacent first tool aperture 24, 24' and convex-shaped portion 20*a*, 20*a'* adjacent second tool aperture 26, 26'. One advantage of serpentine-shaped sides is to provide a greater range of pivotal motion of a clip-type fastener along longitudinal axis 100 relative to body side 19, 19' that is connected directly to first or second tool apertures 24, 24', 26, 26'. This is especially helpful when attaching and/or detaching a connector to drop prevention anchor 10, 10'.

Figure 5A:
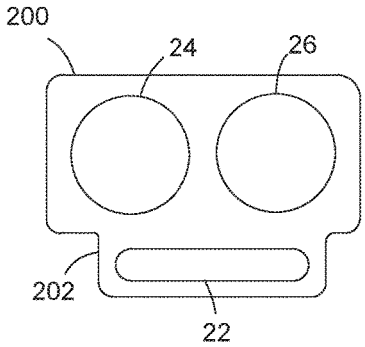
FIGS. 5A, 5B, 5C, and 5D are top plan views of alternative embodiments of the drop prevention anchor showing other configurations.
Figure 5B:
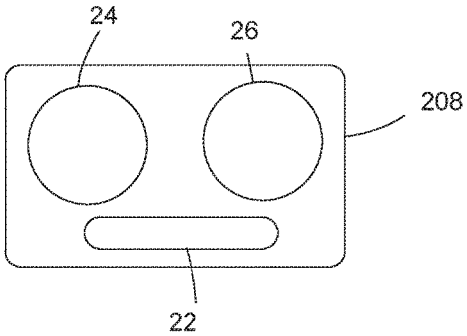
Figure 5C:
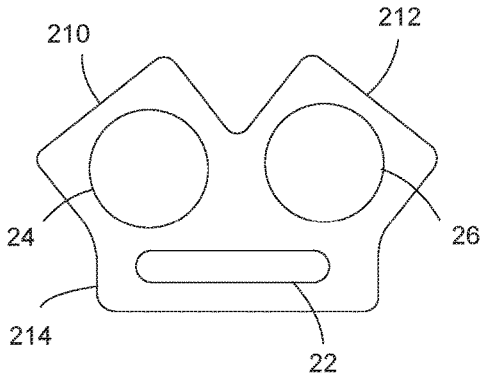
Figure 5D:
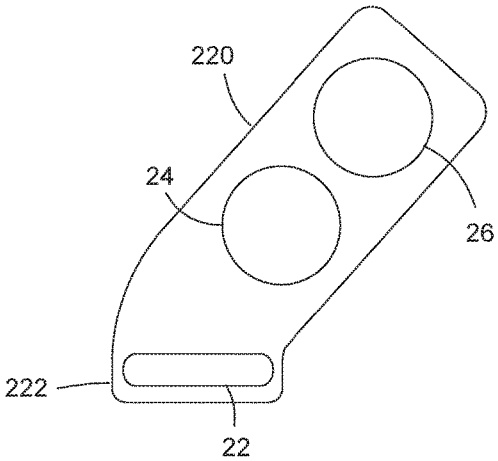

FIGS. 5A, 5B, 5C, and 5D illustrate other circumferential shapes for drop prevention anchor 10. FIG. 5A illustrates a T-shaped configuration where first and second tool apertures 24, 26 are disposed in the top portion 200 of the T-shaped elongated body 12 while the elongated slot 22 is disposed within the leg 202 of the T-shaped elongated body 12. FIG. 5B has a rectangularly-shaped configuration 208 where elongated slot 22 is parallel to first and second tool apertures 24, 26. FIG. 5C illustrates a Y-shaped configuration where each of first and second tool apertures 24, 26 are disposed in one of the corresponding legs 210, 212 and elongated slot 22 is disposed in the lower leg 214. FIG. 5D illustrates an angled-configuration where first and second tool apertures 24, 26 are disposed in one leg 220 while elongated slot 22 is disposed in the other leg 222. Regarding cross-sectional shapes, drop prevention anchor 10 or any portion of drop prevention anchor 10 may have a cross-sectional shape including, but not limited to, circular, square, rectangular, oval, elliptical, dumbbell shaped, hour-glass shaped, or any other shape including combinations of shapes at various cross-sections of drop prevention anchor 10.

Figure 6:
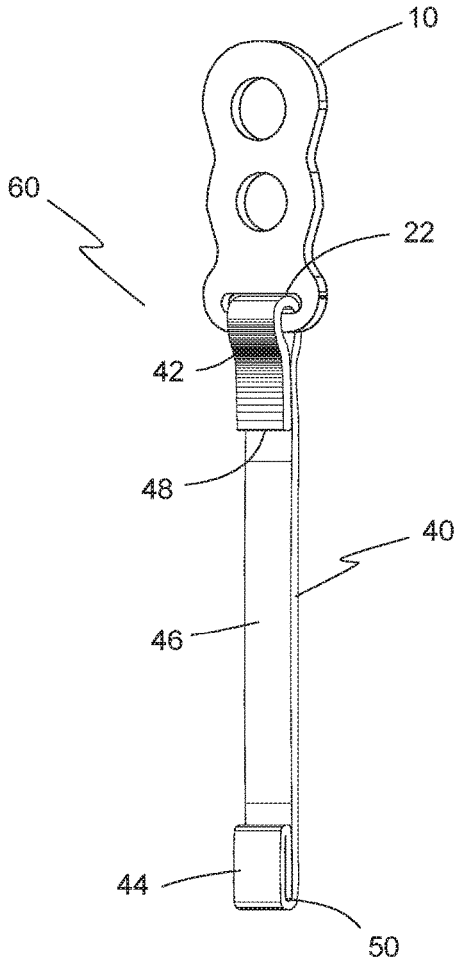
FIG. 6 is a front perspective view of the drop prevention anchor of FIG. 1 with an anchor securing leader attached to a leader aperture in the proximal end portion.
Figure 7:
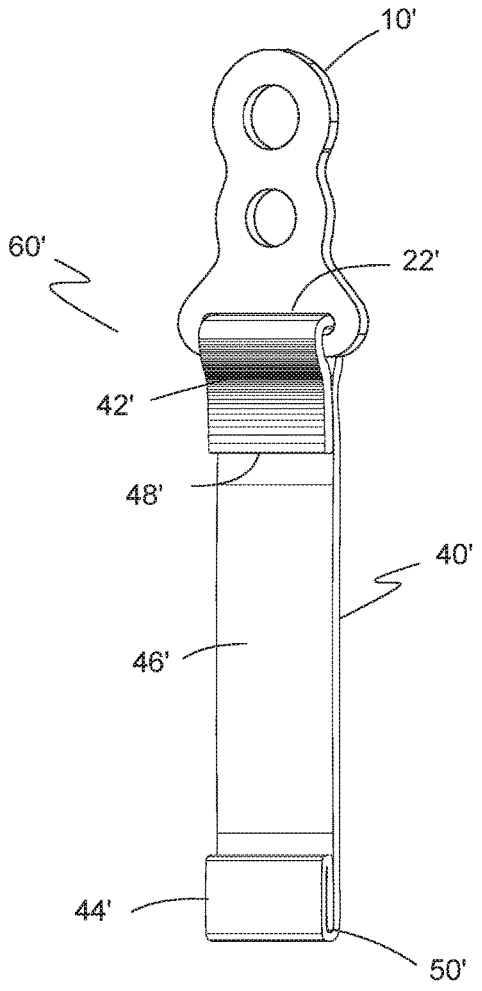
FIG. 7 is a front perspective view of the drop prevention anchor of FIG. 3 with an anchor securing leader attached to a leader aperture in the proximal end portion.
Figure 7A:
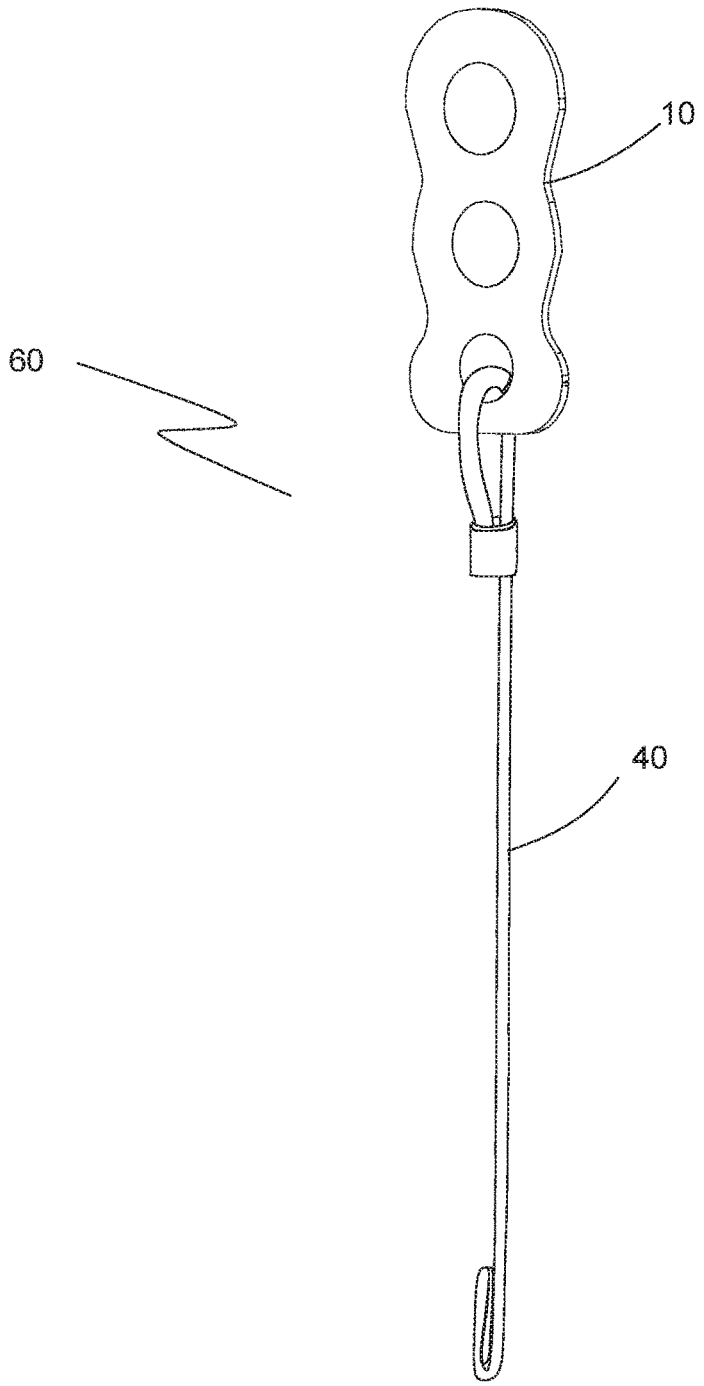
FIG. 7A is a front perspective view of the drop prevention anchor of FIG. 1 showing an anchor securing leader that is a cord attached to a leader aperture in the proximal end portion.

Turning now to FIGS. 6 and 7, there is illustrated drop prevention anchors 10, 10' each with an anchor securing leader 40, 40' forming drop prevention assembly 60, 60', respectively. Anchor securing leaders 40, 40' are typically in the form of a strap but may be any cord or other like component. Anchor-securing leaders 40, 40' are preferably nylon webbing, but may be made of other woven, non-woven, knitted, braided, or solid materials including, but not limited to rubber, cloth, metal, and plastic. Each of anchor securing leaders 40, 40' has an anchor leader body 41 forming a proximal leader end portion 42, 42', a distal leader end portion 44, 44', a leader middle portion 46, 46', a proximal leader end 48, 48', and a distal leader end 50, 50'. Proximal leader end portion 42, 42' is disposed through elongated slot 22, 22' and retains drop prevention anchor 10, 10' securely to anchor securing leader 40, 40', respectively. Proximal leader end 48, 48' is inserted through the respective elongated slot 22, 22' of drop prevention anchor 10, 10' and secured to anchor securing leaders 40, 40' forming proximal leader end portions 42, 42'. Distal leader end 50, 50' of anchor securing leader 40, 40' is folded upon itself forming distal leader end portions 44, 44'. The thickness of distal leader end portions 44, 44' is thicker than their respective leader middle portions 46, 46'. Proximal leader end 48, 48' and distal leader end 50, 50' are typically secured to respective proximal leader end portions 42, 42' and distal leader end portions 44, 44' by stitching, fasteners, adhesive or other means. Notwithstanding that a distal leader end portion 44, 44' that is thicker than the respective leader middle portions 46, 46' is illustrated, folding of distal leader ends 50, 50' upon itself is optional. Folding distal leader ends 50, 50' is advantageous since it creates a structure that makes it difficult for anchor securing leader 40, 40' to be pulled out of and released from a hand tool to which it is attached. This means that the drop prevention assembly 60, 60' of the anchor securing leader 40, 40' and drop prevention anchor 10, 10' can withstand a greater force imparted to the assembly 60, 60' when there is an inadvertent and/or accidental drop of a hand tool that is connected to a hand tool lanyard by way of the assembly 60, 60'. FIG. 7A illustrates an example of a drop prevention assembly where the anchor securing leader is a cord or rope.

Figure 8:
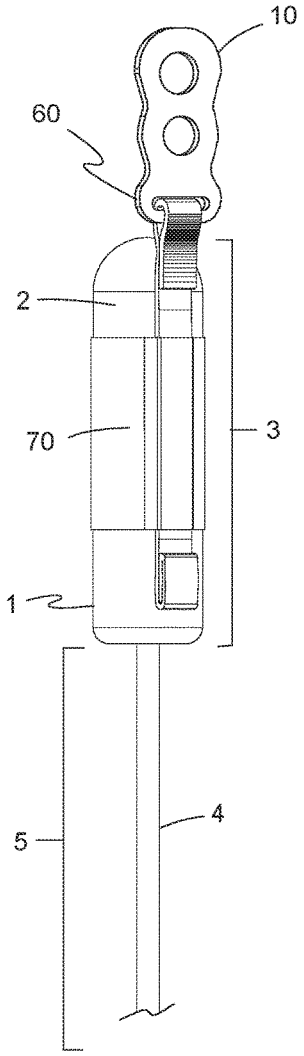
FIG. 8 is a front perspective view of the drop prevention anchor of FIG. 1 with the anchor securing leader secured to a hand tool.
Figure 9:
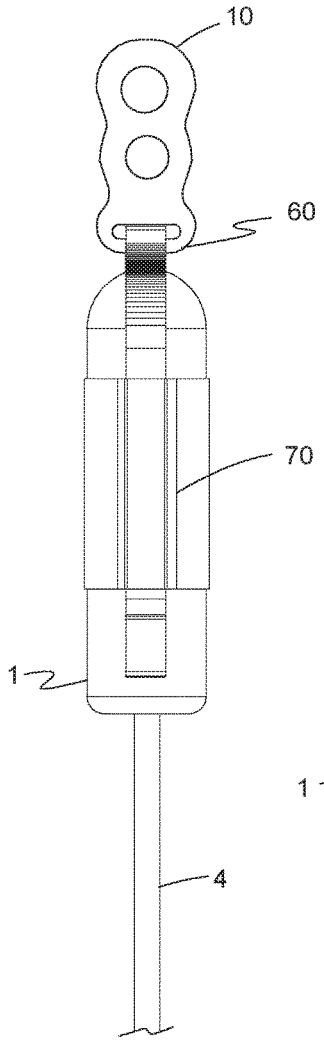
FIG. 9 is a front plan view of the drop prevention anchor with the anchor securing leader secured to the hand tool of FIG. 8.
Figure 10:
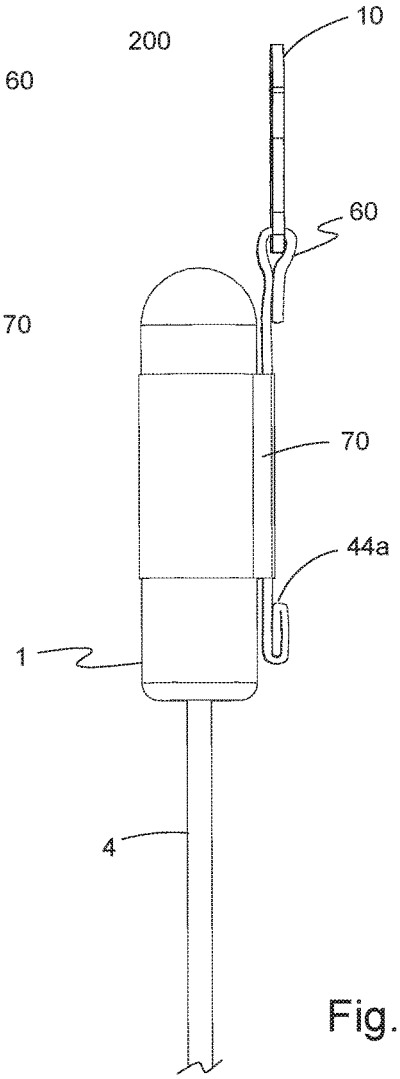
FIG. 10 is a side plan view of the drop prevention anchor and hand tool of FIG. 8.

FIGS. 8, 9 and 10 illustrate one embodiment of drop prevention assembly 60 affixed to a hand tool 1. FIG. 8 illustrates a perspective view of drop prevention assembly 60 assembled to a handle portion 2 of hand tool 1, which handle portion 2 is considered a non-working end 3 of hand tool 1 whereas a tool portion 4 is considered a working end 5 of hand tool 1. As can be seen, leader middle portion 46 is held securely to handle portion 2 by an assembly fixing component 70. Assembly fixing component 70 may be heat shrink tubing or self-fusing silicone rubber tape.

FIG. 9 illustrates a front elevation view of drop prevention assembly 60 securely attached to handle 2 of hand tool 1. FIG. 10 illustrates a side view of drop prevention assembly 60 securely attached to handle 2 of hand tool 1. This view particularly shows the benefit of including optional folded distal end portion 44. Distal end portion 44 creates a catch surface 44*a* that prevents drop prevention assembly 60 from being pulled out from underneath assembly fixing component 70 in the direction of arrow 200 when a pull force is placed on drop prevention anchor 10 caused by an attached hand tool 1 that is inadvertently and/or accidentally dropped.

One method of securing drop prevention assembly 60, 60' uses heat-shrink tubing to connect anchor-securing leader to the hand tool. One anchor-securing leader, known to some as a "web tail," is a length of webbing with a first end looped through the elongated slot 22, 22' of drop prevention anchor 10, 10' and then secured to itself, typically by stitching, adhesives, fasteners, and the like as is well known in the art, to attach the drop prevention anchor 10, 10' to the length of webbing. The anchor-securing leader 40, 40' is attached to the tool handle 2 by using heat shrink tubing as assembly fixing component 70 positioned around the tool handle with anchor securing leader 40, 40' between the shrink tubing and the tool handle. In the embodiment where optional distal leader end portion 44, 44' is formed on anchor securing leader 40, 40', distal leader end portion 44, 44' creates first catch surface 44*a*. Distal leader end portion 44, 44' and drop prevention anchor 10, 10' are preferably positioned outside and beyond the ends of the shrink tubing. After positioning the heat shrink tubing, the tubing is heated to constrict its size to capture drop prevention assembly 60, 60' to the tool handle 2, thereby fixing the drop prevention assembly 60, 60' to the tool handle 2.

In another approach, the user places drop prevention assembly 60, 60' along the handle 2 of a hand tool 1. A self-fusing silicone rubber tape is then wrapped tightly around the tool 1 and over the anchor-securing leader 40, 40' while also slightly stretching the tape. The tape adheres to itself to secure anchor-securing leader 40, 40' to the hand tool 1, thereby attaching anchor-securing leader 40, 40' to the hand tool 1 and providing a connection point for a spring clip or other connector. This approach has been found to be satisfactory for tools having a weight below five pounds.

Figure 11:
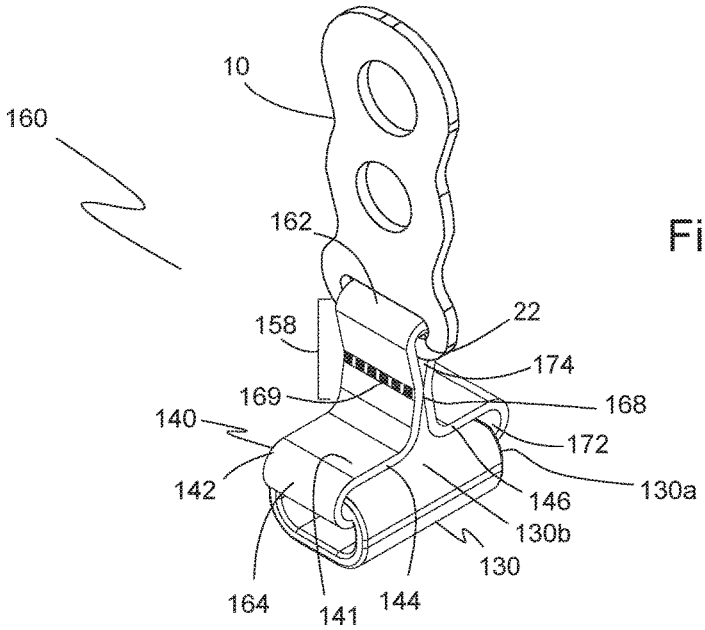
FIG. 11 is a perspective view of another embodiment of a drop prevention assembly of the present invention.

FIGS. 11 and 13 illustrate another embodiment of anchor leader 140 as part of drop prevention assembly 160 that also includes a sleeve 130. In this embodiment, anchor leader 140 has a structure where anchor leader body 141 is a strap that forms a closed loop 142 that defines a primary opening 172 and a secondary opening 174 through closed loop 142. Forming primary opening 172 and secondary opening 174, a fastening means 169 secures a first strap portion 144 to a second strap portion 146 at a first strap connection point 168 that is positioned between a first turn 162 and a second turn 164. Fastening means 169 is preferably stitching and may be replaced or supplemented by one or more other fastening means. A portion of sleeve 130 passes through primary opening 172 to link sleeve 130 to anchor leader 140. A portion of anchor leader 140 of secondary opening 174 passes through elongated slot 22, 22' of anchor 10, 10', linking drop prevention anchor 10, 10' to strap 140. Thus, sleeve 130, strap 140, and drop prevention anchor 10 are linked together.

A first end portion 158 of closed loop 142 includes first turn 162, fastening means 169, secondary opening 174, and portions of first strap portion 144 and second strap portion 146 that are positioned between fastening means 169 and first turn 162. First end portion 158 may be positioned over a middle sleeve portion 130*b* as shown in FIG. 11 so as to extend transversely away from middle sleeve portion 130*b* and, when installed on a tool 110, in a transverse direction away from the handle or middle portion of tool 110. Alternately, first end portion 158 in one embodiment shown in FIG. 13 is positioned to extend from a first sleeve end 130*a* away from sleeve 130 so as to lay relatively flat along an adjacent handle or middle portion of a tool. For example, first end portion 148 is positioned as shown in FIG. 11 over sleeve 130 by rotating closed loop 142 about sleeve 130 by approximately 90 degrees (as compared with the position shown in FIG. 13, which is considered to be in a 0-degree position). Rotating closed loop 142 about sleeve 130 in order to position first end portion 158 as desired is facilitated by making anchor leader 140 of a flexible strap material that conforms to the shape of sleeve 130 as needed. Flexible strap materials include, for example, woven nylon, cotton, woven or non-woven fabrics, and polypropylene strapping.

Figure 12:
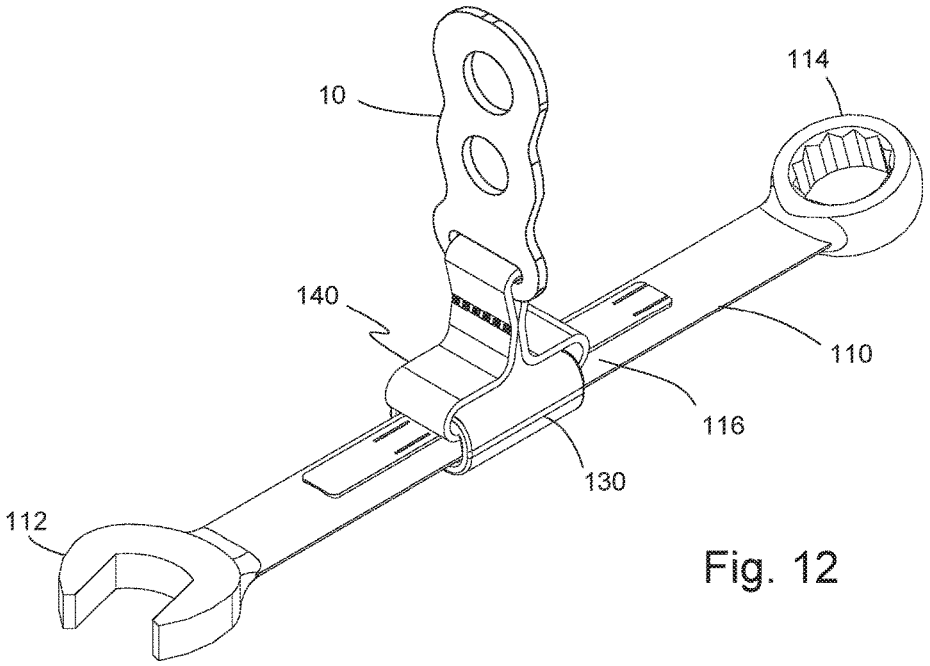
FIG. 12 is a perspective view of the drop prevention assembly of FIG. 11 attached to a hand tool.

FIGS. 12 and 14 illustrate the embodiment of drop prevention assembly 160 shown in FIGS. 11 and 13 installed on a hand tool 110. Drop prevention assembly 160 is secured to tool 110 by forming a snug fit to a handle or middle portion 116. Tool 110 is a combination wrench, but drop prevention assembly 160 may be used with other tools and objects including, for example, screwdrivers, utility knives, adjustable wrenches, hex wrenches, channel locks, pliers, punches, ratchet wrenches, flashlights, chisels, and the like.

In another embodiment of the present invention, FIG. 15 illustrates an anchor leader 140 with a structure where an anchor leader body 141 forms only a single closed loop 142 that defines a primary opening 172 where a portion of sleeve 130 passes through primary opening 172 to link sleeve 130 to anchor leader 140. Anchor leader 140 is fixedly secured to itself, forming a closed loop 142 and linking sleeve 130 to drop prevention anchor 10. FIG. 16 illustrates the embodiment of drop prevention assembly 160 shown in FIG. 15 installed on a hand tool 110. Drop prevention assembly 160 is secured to tool 110 by forming a snug fit to a handle or middle portion 116. Because this embodiment of anchor leader 140 has only a primary opening 172, drop prevention anchor 10 is free to slide along the length of anchor leader 140. As described previously, tool 110 is a combination wrench, but drop prevention assembly 160 may be used with other tools and objects including, for example, screwdrivers, utility knives, adjustable wrenches, hex wrenches, channel locks, pliers, punches, ratchet wrenches, flashlights, chisels, and the like.

As shown, tool 110 has a first end 112 (e.g., an open end of a combination wrench), a second end 114 (e.g., a box end of a combination wrench), and a handle or middle portion 116 extending between first end 112 and second end 114. Drop prevention assembly 160 is particularly useful for tools having two functioning ends but either or both of first end 112 and second end 114 may be a featureless end of handle or middle portion 116. Thus, drop prevention assembly 160 is not limited for use with tools and could be used, for example, on a rod, block, or an irregular object. In the embodiment of drop prevention assembly 160 shown in FIG. 16, anchor leader 140 is configured with sufficient slack around sleeve 130 to enable anchor leader 140 to move along closed loop 142 between first end portion 163 and second end portion 165.

Figure 17:
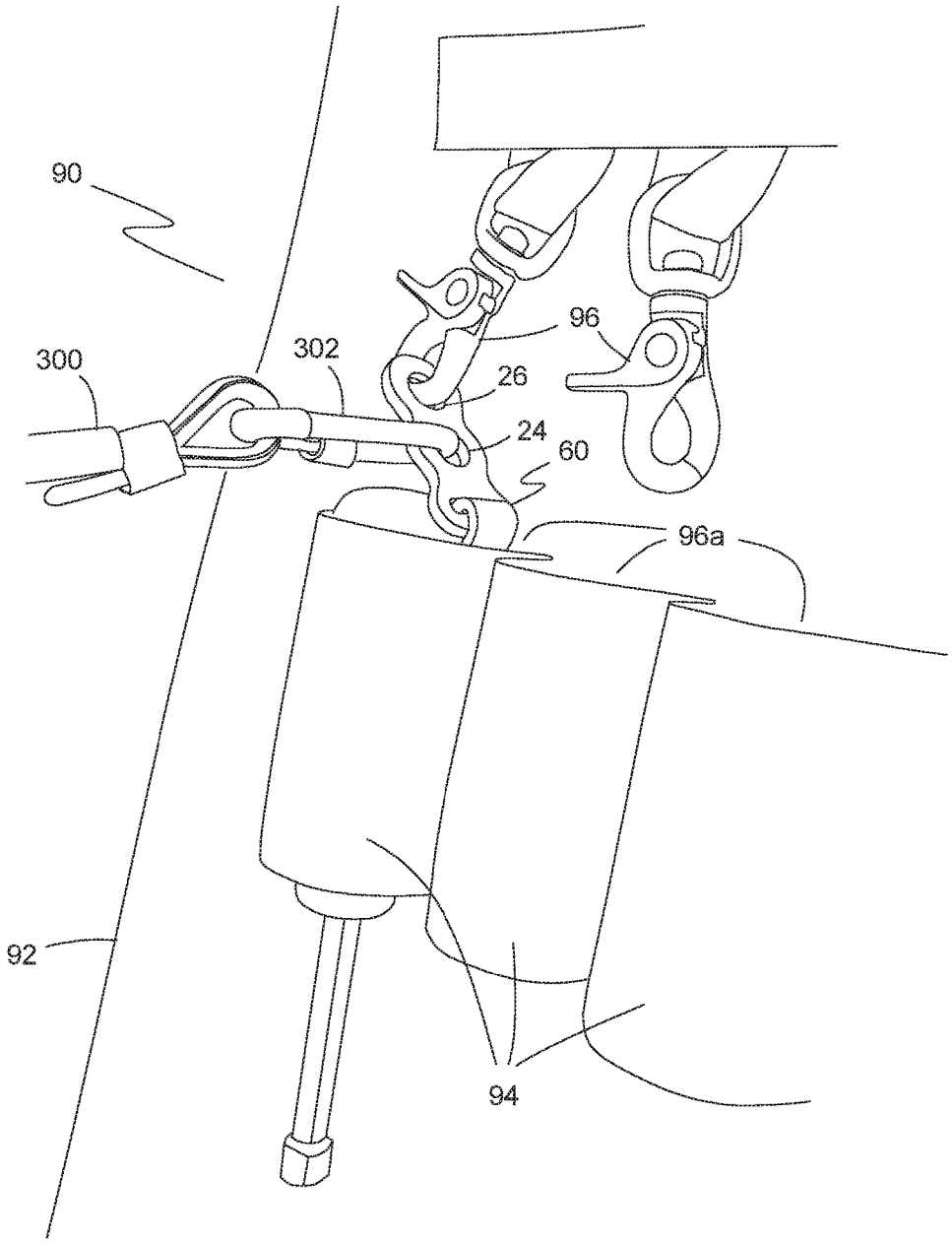
FIG. 17 is a perspective view of one embodiment of the drop prevention system of the present invention showing the drop prevention anchor on a hand tool in a hand tool pouch with a lanyard connector and a tool securing connector directly attached to the drop prevention anchor.

Turning now to FIG. 17, there is illustrated one embodiment of a drop prevention assembly 90 of the present invention. In this embodiment, drop prevention assembly 90 includes a tool pouch 92 having one or more tool pockets 94 for receiving anyone of a variety of a hand tool 1 and a one or more tool securing connectors 96 fixedly attached to tool pouch 92 where each tool securing connector 96 is adjacent to a top open end 96*a* of a corresponding tool pocket 94. Hand tool 1, in this case being a nut driver, is disposed in one tool pocket 94. Hand tool 1 has drop prevention assembly 60 secured to handle 2. As can be seen in FIG. 11, drop prevention assembly 60 has a corresponding tool securing connector 96 attached to one of tool apertures 24, 26. In this case, it is attached to aperture 26. There is also shown a hand tool lanyard 300 connected to the other one of the tool apertures 24, 26, which in this case is tool aperture 24, by way of a lanyard connector 302. Both tool securing connector 96 and lanyard connector 302 are removably connectable directly to drop prevention assembly 60. Each of the tool securing connector 96 or the lanyard connector 302 may be any closed or partially-closed connector including an O-ring, a carabiner, a shackle, split ring, a tri-loop, an open ring, a loop, a snap hook, a spring clip, or a spring buckle.

In use, drop prevention system 90 will now be explained. The use of prior art tool lanyards typically involves attaching a tool lanyard to a hand tool in a tool pouch or tool belt. Unfortunately, the hand tool is typically supported in a tool pouch or tool belt but not secured to the tool pouch or tool belt. The user normally picks up the hand tool from the tool pouch or tool belt and then attaches the tool lanyard to the hand tool. It is at this point in time between removal of the hand tool from the tool pouch or tool belt and securing the hand tool lanyard to the hand tool that there is the vulnerability of an inadvertent or accidental drop. If this occurs, any equipment below the dropped tool can be damaged and, even worse, if a worker is below the dropped tool, the worker may sustain injuries from the dropped tool. The purpose of the drop prevention system 90 is to ensure that an inadvertent or accidental drop of an unsecured hand tool is prevented.

In the drop prevention system of the present invention, a hand tool 1 is always attached to either a hand tool lanyard 300 or a tool pouch/tool belt 92 so that the hand tool 1 cannot be separated from either the hand tool lanyard 300 or the tool pouch/tool belt 92. This eliminates any chance that the hand tool 1 is inadvertently or accidentally dropped without being secured to either the lanyard 300 or the tool pouch/tool belt 92. A hand tool 1 with a drop prevention assembly 60 attached thereto is disposed in a tool pouch/tool belt 92 having a structure such as a tool pocket 94 or other known structure to support and receive the hand tool 1 as well as a tool securing connector 96 fixedly attached to the tool pouch/tool belt 92 where the tool securing connector 96 is located near the tool pocket 94. Next, the tool securing connector 96 is connected to one of the first tool aperture 24 or the second tool aperture 26 of the drop prevention anchor 10 of the drop prevention assembly 60. This secures the hand tool 1 to the hand tool pouch/tool belt 92 so that the hand tool 1 does not separate or fall out of the tool pouch/tool belt 92.

When a user wants to use the hand tool 1 using the drop prevention system 90 of the present invention, the user attaches a hand tool lanyard 300 using the lanyard connector 302 to the hand tool 1 by securing the lanyard connector 302 to the other of the first and second tool apertures 24, 26 of the drop prevention anchor 10. Once the lanyard connector 302 is secured to drop prevention anchor 10, the tool-securing connector 96 of the tool pouch 92 that is also connected to the drop prevention anchor 10 is detached from the drop prevention anchor 10. The user then withdraws the hand tool 1 from the tool pocket 94 or other structure that is supporting the hand tool 1 for use.

When the user wishes to return the hand tool 1 to the tool pouch/tool belt 92, the user inserts the hand tool 1 into the tool pocket 94 or other tool holding structure of the tool pouch/tool belt 92. The user then attaches the tool securing connector 96 of the tool pouch/tool belt 92 to the available first or second tool aperture 24, 26 of the drop prevention anchor 10. Once the tool securing connector 96 is secured to the drop prevention anchor 10, then the lanyard connector 302 is detached from the drop prevention anchor 10. In this way, the hand tool 1 is always connected to either the tool securing connector 96 or the lanyard connector 302.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A drop prevention apparatus and system for hand tools, the apparatus and system comprising:

a drop prevention anchor comprising:

an anchor body having a proximal body end portion, a middle body portion and a distal body end portion;

a leader aperture disposed completely through the anchor body in the proximal body end portion, the leader aperture sized to permit secure attachment of an anchor securing leader therethrough;

a first tool aperture disposed completely through the anchor body in the middle body portion, the first tool aperture sized to permit secure attachment of one of a lanyard connector of a hand tool lanyard or a tool securing connector of a hand tool pouch/tool belt to the first tool aperture; and a second tool aperture disposed completely through the anchor body in the distal body end portion, the second tool aperture sized to permit secure attachment of the other of the lanyard connector or the tool securing connector to the second tool aperture; and an anchor securing leader having a structure where the structure is one of (a) an anchor leader body comprising a distal leader end, a proximal leader end securely connected to the leader aperture, and a leader middle portion wherein the anchor leader body has a predefined length sufficient to permit binding of at least the leader middle portion to a hand tool, or (b) an anchor leader body forming a closed loop that includes a primary opening and a secondary opening with a sleeve passing through the primary opening and a portion of the anchor leader body of the secondary opening passing through the leader aperture, or (c) an anchor leader body forming a single closed loop with only a primary opening with a sleeve passing therethrough and a portion of the anchor leader body passing through the leader aperture.

2. The apparatus and system of claim 1 wherein the distal leader end of structure (a) has a thickness greater than a thickness of the leader middle portion.

3. The apparatus and system of claim 1 further comprising a hand tool pouch/tool belt having a tool securing connector fixedly attached thereto and positioned on the hand tool pouch/tool belt wherein the tool securing connector is capable of releasable but secure connection directly to the drop prevention anchor when the drop prevention anchor is attached to a hand tool.

4. The apparatus and system of claim 1 wherein the proximal body end portion is wider than either of the middle body portion or the distal body portion.

5. The apparatus and system of claim 1 wherein the anchor leader is a strap made of a material selected from woven, non-woven, knitted, braided, or solid material.

6. The apparatus and system of claim 5 wherein the solid material is made of rubber, cloth, metal, plastic, or any combination thereof.

7. The apparatus and system of claim 5 wherein the anchor securing leader is made of nylon webbing.

8. The apparatus and system of claim 1 wherein the anchor body is a planar elongated body.

9. The apparatus and system of claim 8 wherein the planar elongated body of the drop prevention anchor has at least one serpentine side extending between the proximal body end portion and the distal body end.

10. The apparatus and system of claim 8 wherein each one of the first tool aperture and the second tool aperture of the drop prevention anchor is adjacent to and aligned with a convex-shaped portion of the serpentine side with a concave-shaped portion of the serpentine side between the convex-shaped portion adjacent the first tool aperture and the convex-shaped portion adjacent the second tool aperture.

11. The apparatus and system of claim 9 wherein the planar elongate body of the drop prevention anchor has a second serpentine side opposite the at least one serpentine side, the second serpentine side extending between the proximal body end portion and the distal body end.

12. A method of tethering a hand tool that maintains the hand tool being secured at all times, the method comprising:

providing a hand tool with a drop prevention anchor connected to the hand tool;

providing a tool pouch with at least one tool securing connector fixedly attached to the hand tool pouch wherein the tool securing connector is releasably connectable directly to the drop prevention anchor;

disposing the hand tool in a tool holding structure of the tool pouch/tool belt and securing the tool securing connector to one of a first or second tool aperture of the drop prevention anchor;

providing a hand tool lanyard having a lanyard connector capable of releasably connecting directly to the drop prevention anchor;

attaching the lanyard connector directly to the other of the first or second tool aperture of the drop-prevention anchor before releasing the tool securing connector of the hand tool pouch from the drop prevention anchor; and releasing the tool securing connector of the hand tool pouch from the drop prevention anchor after the lanyard connector is secured to the drop prevention anchor.

13. The method of claim 12 further comprising providing a drop prevention anchor having a planar elongated body with a proximal body end portion, a middle body portion and a distal body end portion, a leader aperture disposed completely through the elongated body in the proximal body end portion, the first tool aperture disposed completely through the elongated body in the middle body portion, the second tool aperture disposed completely through the elongated body in the distal body end portion, and an anchor securing leader with a proximal leader end securely connected to the leader aperture in the proximal body end portion of the drop prevention anchor and with the leader middle portion bound to the hand tool.

14. The method of claim 12 further comprising ensuring that the hand tool is always connected to either the lanyard connector of the hand tool lanyard or the tool securing connector of the hand tool pouch by always having at least one of the lanyard connector and the tool securing connector directly connected to the drop prevention anchor.

15. The method of claim 12 further comprising:

returning the hand tool with the hand tool lanyard connected thereto to the hand tool pouch;

attaching the tool securing connector of the tool pouch to the drop prevention anchor connected to the hand tool lanyard of the hand tool; and then releasing the lanyard connector of the hand tool lanyard from the drop prevention anchor after attaching the tool securing connector thereby ensuring that the hand tool is always connected to one of the lanyard connector of the hand tool lanyard or the tool-securing connector of the hand tool pouch.

* * * * *